US007992809B1

(12) United States Patent
Barnett

(10) Patent No.: US 7,992,809 B1
(45) Date of Patent: Aug. 9, 2011

(54) MANUAL AIR-ACTUATED SPRAY PAINT APPARATUS AND ASSOCIATED METHOD

(76) Inventor: Leonard Barnett, North Hollywood, CA (US)

( * ) Notice: Subject to any disclaimer, the term of this patent is extended or adjusted under 35 U.S.C. 154(b) by 241 days.

(21) Appl. No.: 12/220,096

(22) Filed: Jul. 22, 2008

Related U.S. Application Data

(60) Provisional application No. 60/963,553, filed on Aug. 6, 2007.

(51) Int. Cl.
*B05B 7/02* (2006.01)

(52) U.S. Cl. ..... 239/526; 239/8; 239/525; 239/310; 239/302; 239/337; 239/461; 239/463; 239/468; 239/456; 239/472; 239/398; 239/399; 239/375; 239/381; 239/318; 239/518; 222/190; 222/401; 222/321.7; 222/383.3

(58) Field of Classification Search ..... 239/333, 239/302, 331, 329, 339, 337, 461, 468, 456, 239/525, 398, 399, 403, 375, 378, 380, 381, 239/382, 237, 466, 494, 463, 490, 481, 526, 239/467, 472, 432, 318, 406, 510, 511, 512, 239/518, 8; 222/190, 383.3, 321.7, 401; 169/14
See application file for complete search history.

(56) References Cited

U.S. PATENT DOCUMENTS

| | | | | | |
|---|---|---|---|---|---|
| 334,800 | A * | 1/1886 | O'Donnel | ..... | 239/481 |
| 2,499,447 | A * | 3/1950 | Axelson et al. | ..... | 239/133 |
| 4,079,891 | A * | 3/1978 | Kwan | ..... | 239/381 |
| 4,123,007 | A * | 10/1978 | Gardner | ..... | 239/414 |
| 4,288,036 | A * | 9/1981 | Jubinville | ..... | 239/345 |
| 4,562,965 | A * | 1/1986 | Ihmels et al. | ..... | 239/346 |
| 5,131,598 | A * | 7/1992 | Hoogeveen, Jr. | ..... | 239/223 |
| 5,156,340 | A * | 10/1992 | Lopes | ..... | 239/414 |
| 5,322,220 | A * | 6/1994 | Rehkemper | ..... | 239/214 |
| 5,624,060 | A | 4/1997 | Ellion et al. | | |
| 5,961,050 | A * | 10/1999 | Kitajima | ..... | 239/346 |
| 6,189,809 | B1 * | 2/2001 | Schwebemeyer | ..... | 239/304 |
| 6,223,380 | B1 | 5/2001 | Klima | | |
| 6,983,864 | B1 | 1/2006 | Cagle | | |
| 2006/0273194 | A1 * | 12/2006 | Kapich | ..... | 239/214.11 |

* cited by examiner

*Primary Examiner* — Dinh Q Nguyen
*Assistant Examiner* — Trevor E McGraw

(57) ABSTRACT

Provided is a manual air-actuated spray paint apparatus and associated method for evenly disbursing paint in a controlled manner. Such an apparatus preferably includes a portable reservoir for holding the paint therein and a hand-actuated paint applicator removably coupled thereto. A mechanism for simultaneously discharging a single stream of paint and a volume of air may also be included. A discharge spout is removably mated to and in fluid communication with the paint applicator for mixing the single paint stream and the volume of air as they pass through the spout. A trigger is pivotally mated to the housing and is articulated between tensioned and released positions to activate the paint discharging mechanism. When the trigger is engaged, the paint is directed upwardly out of the reservoir and travels out the discharge spout to be applied to the surface intended to receive the paint.

13 Claims, 11 Drawing Sheets

MANUAL AIR-ACTUATED SPRAY PAINT APPARATUS AND ASSOCIATED METHOD

CROSS REFERENCE TO RELATED APPLICATIONS

This application claims the benefit of U.S. Provisional Application No. 60/963,553, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to paint sprayers and, more particularly, to a manual air-actuated spray paint apparatus for evenly disbursing paint in a controlled manner.

2. Prior Art

A fresh coat of paint can vastly improve or completely alter the appearance of most homes. Whether using a neutral white or eggshell color to cover scuff marks or a vibrant and bold color in order to change the entire design scheme of a room, homeowners and designers alike use paint as both a functional and decorative medium. Consisting of pigments and emulsions suspended in a liquid base, paint also consists of countless compounds which are uniquely formulated to meet the various requirements of literally hundreds of thousands of applications. Although the first paint was used in caves over 30,000 years ago, the modern paint industry became a key contributor to the U.S. economy during the mid 1800's. It was at this time that an Ohio man by the name of D. R. Averill patented the first "ready mixed" paint, and within twenty years of this patent, factories which specialized in paint production sprang up across the nation. Today, the paint industry is booming like never before. In fact, according to recent statistics compiled by the Paint and Coatings Industry Information Center, recent sales of interior and exterior house paint reached almost $17 billion, and that number is steadily on the rise. With reputable companies such as Glidden, Behr, Sears, and Olympic producing quality paint at affordable prices and top designers such as Ralph Lauren, Laura Ashley, Julien Alexander, and Martha Stewart all offering chic designer versions and unlimited color palettes, the popularity of decorating with paint should never diminish.

Often times following a painting task, consumers find it necessary to complete minor touch ups. Whether one has "missed a spot" when painting, or if the applied paint has become scratched, chipped, or otherwise marred, there are many occasions which require one to drag out the paint supplies in order to complete minor repairs. Unfortunately, assembling the needed painting supplies—merely in order to cover a few inches of space—can be time consuming at best. A daunting task, assembling a paint brush, roller and paint, all in order to apply paint to a small spot on the wall or ceiling can be a complete hassle. Obviously, it would be advantageous to provide a means for resolving these types of problems.

U.S. Pat. No. 5,624,060 to Ellion discloses a dispensing system in the form of a pressurized can or hand-pumped bottle, whereby a liquid is dispensed from a container and flows through a composite dip tube that feeds an inlet of a liquid transfer device. The dip tube includes a straight dip tube that extends from the inlet to the bottom of the container and a U-shaped tube that extends to the bottom of the container and then returns to the top of the interior of the container. The U-shaped tube acts as a siphon that, in combination with the conventional dip tube, provides liquid to the liquid transfer device when the container is upright, inverted, or oriented in any other position as long as one of the two open ends of the dip tube is in communication with the liquid. Unfortunately, this prior art example does not provide for a mechanical suction pump configured specifically for dispensing paint and allowing a user to quickly apply an even coat of paint over a variety of surfaces.

U.S. Pat. No. 6,223,380 to Klima discloses a dispensing apparatus that includes a spray bottle dispenser. The apparatus includes a bottle portion, a spray head portion, and a frame portion connecting the dispenser to a surface contacting portion. The surface contacting portion is configured such that when the dispensing apparatus is in an upright position, the surface contacting portion is located above and in front of a nozzle portion of the spray head portion. Unfortunately, this prior art example does not provide a mechanical suction pump preferably constructed of steel and designed for dispensing paint.

U.S. Pat. No. 6,983,864 to Cagle discloses a fluid dispenser with a replaceable receptacle to house fluid. An inlet tube and an outlet tube are connected to a pump assembly for drawing fluid from the receptacle and moving the fluid through a nozzle with fluid discharge aperture. The nozzle is secured to a hand actuatable cover which is depressible to operate the pump. The pump is mounted upon a retainer which is connectable to the housing. When the receptacle becomes empty, the retainer may be disengaged from the housing, and the retainer and pump are then lifted away as one unit from the housing. The empty receptacle may then be replaced with a full one, and in reverse order, the dispenser may be reassembled. Unfortunately, this prior art reference does not provide an actuator with adjustable flow settings to obtain appropriate levels of paint for a variety of applications.

Accordingly, a manual air-actuated spray paint apparatus is disclosed in order to overcome the above noted shortcomings. The present invention is convenient and easy to use, lightweight yet durable in design, and designed for providing consumers with a simple and convenient means for evenly disbursing paint in a controlled manner. The manual air-actuated spray paint apparatus is simple to use, inexpensive, and designed for many years of repeated use.

BRIEF SUMMARY OF THE INVENTION

In view of the foregoing background, it is therefore an object of the present invention to provide an apparatus for providing users with a simple and convenient means for evenly disbursing paint in a controlled manner allowing a user to apply paint for touch ups and other small tasks without having to connect to an external electrical or air source. These and other objects, features, and advantages of the invention are provided by a manual air-actuated spray paint apparatus.

A manual air-actuated spray paint apparatus for evenly disbursing paint in a controlled manner preferably includes a portable reservoir for holding the paint and a hand-actuated paint applicator. Such a hand-actuated paint applicator may be removably coupled to the reservoir and in fluid communication therewith. This keeps the paint conveniently locked inside the apparatus to prevent spills related to using a brush or roller. The hand-actuated paint applicator may further include a housing provided with first and second rectilinear passageways formed therein to separate the air and paint until ready to be disbursed. The hand-actuated paint applicator may also include a mechanism for simultaneously discharging a single stream of paint and a volume of air along mutually exclusive first and second paths defined within the first and second passageways respectively.

Additionally, the hand-actuated paint applicator preferably includes a discharge spout removably mated to the hand-actuated paint applicator and in fluid communication therewith. Such a discharge spout may include a mechanism for mixing the single paint stream and the volume of air after exiting the first and second passageways and while passing through the discharge spout such that the single stream of paint is scattered along a disrupted path while it is outwardly ejected from a distal end of the discharge spout. Mixing the paint at the discharge spout allows the air passageway to remain free of paint that potentially may dry and affect the operation of the apparatus.

The simultaneous paint and air discharging mechanism may further include a first tube that has an open bottom end situated within the reservoir and is preferably in direct fluid communication with the paint contained therein. Such a first tube may further include an open top end in fluid communication with the first passageway and a second tube with an open bottom end situated within the reservoir and elevated above the paint. Such a second tube may further have an open top end in direct communication with the second passageway. Air is preferably introduced into the reservoir via the second tube to thereby increase air pressure within the reservoir and force the paint out therefrom via the first tube.

The simultaneous paint and air discharging mechanism may further include a stop valve pivotally connected directly to the first and second tubes respectively. Such a stop valve is further preferably selectively articulated along a first curvilinear path defined at the open top ends of the first and second passageways respectively. Additionally, the simultaneous paint and air discharging mechanism may include a first spring member seated within the second passageway that has a trailing end coupled to the stop valve.

Also, the simultaneous paint and air discharging mechanism may include a plunger slidably interfitted within the second passageway. Such a plunger may be coupled to a leading end of the first spring member. Further, a second spring member is preferably included that has a trailing end attached to the plunger. Such a second spring member may be situated distally away from the plunger. The simultaneous paint and air discharging mechanism may include a trigger pivotally mated to the housing. Such a trigger is preferably articulated between tensioned and released positions respectively allowing a user to easily activate the paint and air discharging mechanism manually. The trigger is coupled to a leading end of the second spring member.

The simultaneous paint and air discharging mechanism may also include the first and second spring members extending and compressing linearly along the second passageway when the trigger is articulated along a second curvilinear path. The plunger, which may be distally displaced along the second passageway to prevent interaction with the paint, thereby ejects the volume of air from the second passageway when the trigger is tensioned. Thereafter, the plunger is preferably retracted along the second passageway, thereby drawing in a new volume of air through the second passageway.

The first and second spring members are then preferably caused to return to respective equilibrium positions when the trigger is adapted to the released position. Further, the stop valve may be pivoted away from the open top end of the second tube when the first spring member is returned to equilibrium and may thereby permits the new volume of air to enter the reservoir via the second tube respectively.

The manual air-actuated spray paint apparatus may further include the paint being directed upwardly along the first tube and entering into the first passageway when the trigger is pivoted to the tensioned position. The stop valve may be linearly displaced away from the open top end of the first tube thereby blocking the open top end of the second tube when the first spring member is biased to the extended position. Additionally, the first passageway may have a diameter that is smaller than a diameter of the second passageway so that the single stream of paint exits the reservoir at a faster rate than a rate that the new volume of air enters the reservoir.

The paint and air mixing mechanism preferably further includes a spin wheel rotatably disposed within the discharge spout. Such a spin wheel may be located distally of the first and second passageways respectively. The spin wheel may additionally be rotated about a fulcrum axis disposed subjacent to the first passageway which is advantageous such that each of the single paint stream and the volume of air initially engages a top hemisphere of the spin wheel, thereby causing the spin wheel to rotate along a first arcuate path. The spin wheel rotation preferably causes the single paint stream and the volume of air to become interspersed such that the single paint stream is disrupted into a plurality of paint droplets when exiting the discharge spout. This allows for a wide disbursement of paint droplets so as to cover a larger area with each action and create a smoother application of the paint to the intended surface.

The simultaneous paint and air discharging mechanism may further include a second plunger slidably interfitted within the second passageway and positioned distal to the trigger. A proximal end of the second plunger may be coupled with a shaft. Such a shaft is preferably pivotally mated with the trigger which is important so that second plunger travels away from the trigger on a third exclusive path within the second passageway as the trigger is engaged to a tensioned position.

The simultaneous paint and air discharging mechanism may also include an orifice extending upwardly from the exterior of the housing. Such an orifice may be in fluid communication with the second passageway to permit air to move into the second passageway when the trigger is not engaged. The orifice is preferably located subjacent to the third exclusive path such that it is covered by the second plunger when the trigger is in the tensioned position. In this manner, air that is pulled into the second passageway is prevented from exiting through the orifice and is thereby forced out through the distal end of the second passageway.

The discharge spout may further include a plurality of auxiliary nozzles removably attached thereto for adjusting a flow rate of the paint droplets when exiting the discharge spout. A user can therefore adapt the apparatus to successfully apply paint in different applications, whether a wide spray is needed to cover a larger area or a more narrow spray is needed to touch up corners and grooves.

It is also an object of the present invention to provide a method for manually and evenly disbursing paint in a controlled manner. Such a method preferably includes the first step of providing a portable reservoir for holding the paint therein. A second step of the method may include providing and removably coupling a hand-actuated paint applicator to the reservoir such that the hand-actuated paint applicator is in fluid communication with the reservoir.

The hand-actuated paint applicator may preferably include a housing provided with first and second rectilinear passageways formed therein. A third step of the method may include providing and removably mating a discharge spout to the hand-actuated paint applicator such that the hand-actuated paint applicator is in fluid communication with the discharge spout.

Fourthly, the method may include simultaneously discharging a single stream of the paint and a volume of air along mutually exclusive first and second paths defined within the first and second passageways respectively. The method may include a final step mixing the single paint stream and the volume of air after exiting the first and second passageways and while passing through the discharge spout such that the single stream of paint is scattered along a disrupted path while it is outwardly ejected from a distal end of the discharge spout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
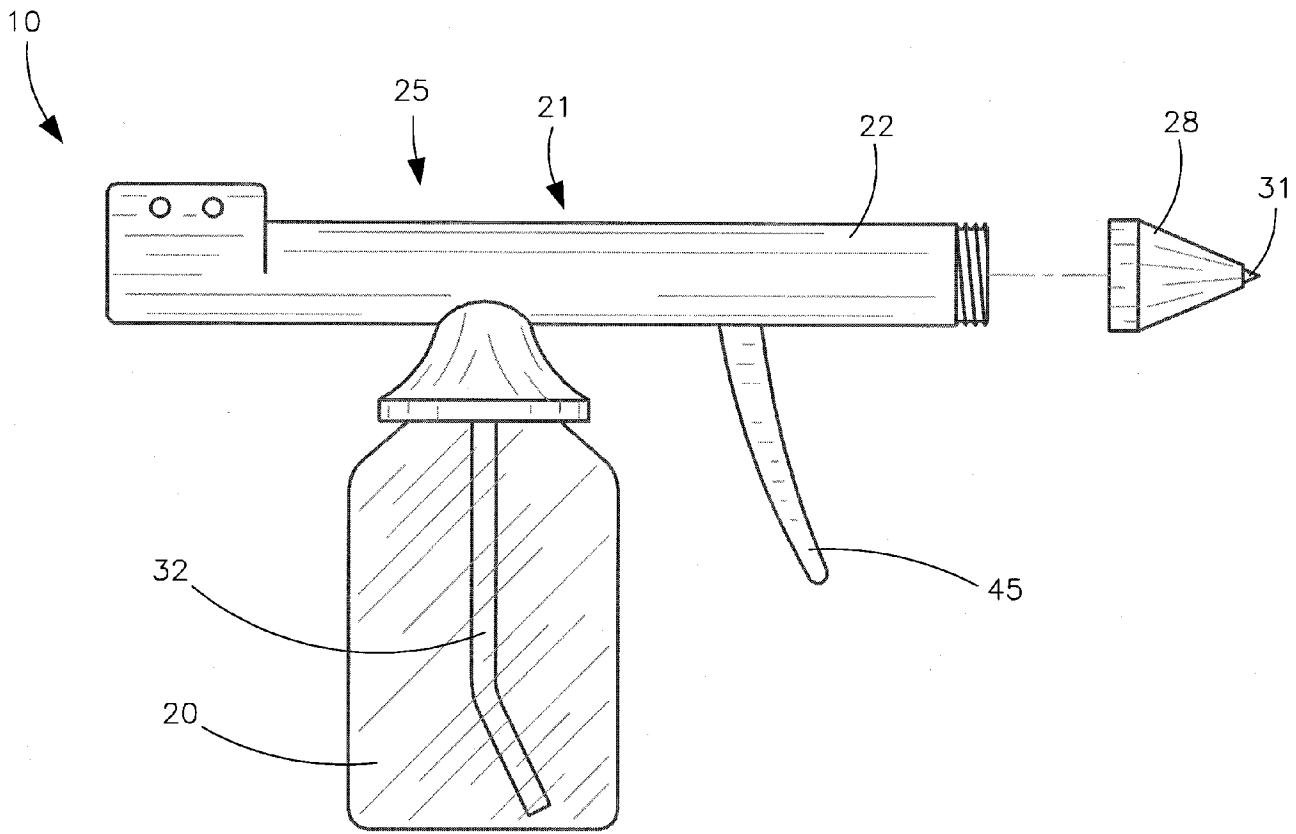
FIG. 1 is a side elevational view showing a manual air-actuated spray paint apparatus with the discharge spout removed from the hand-actuated paint applicator, in accordance with the present invention.
Figure 1A:
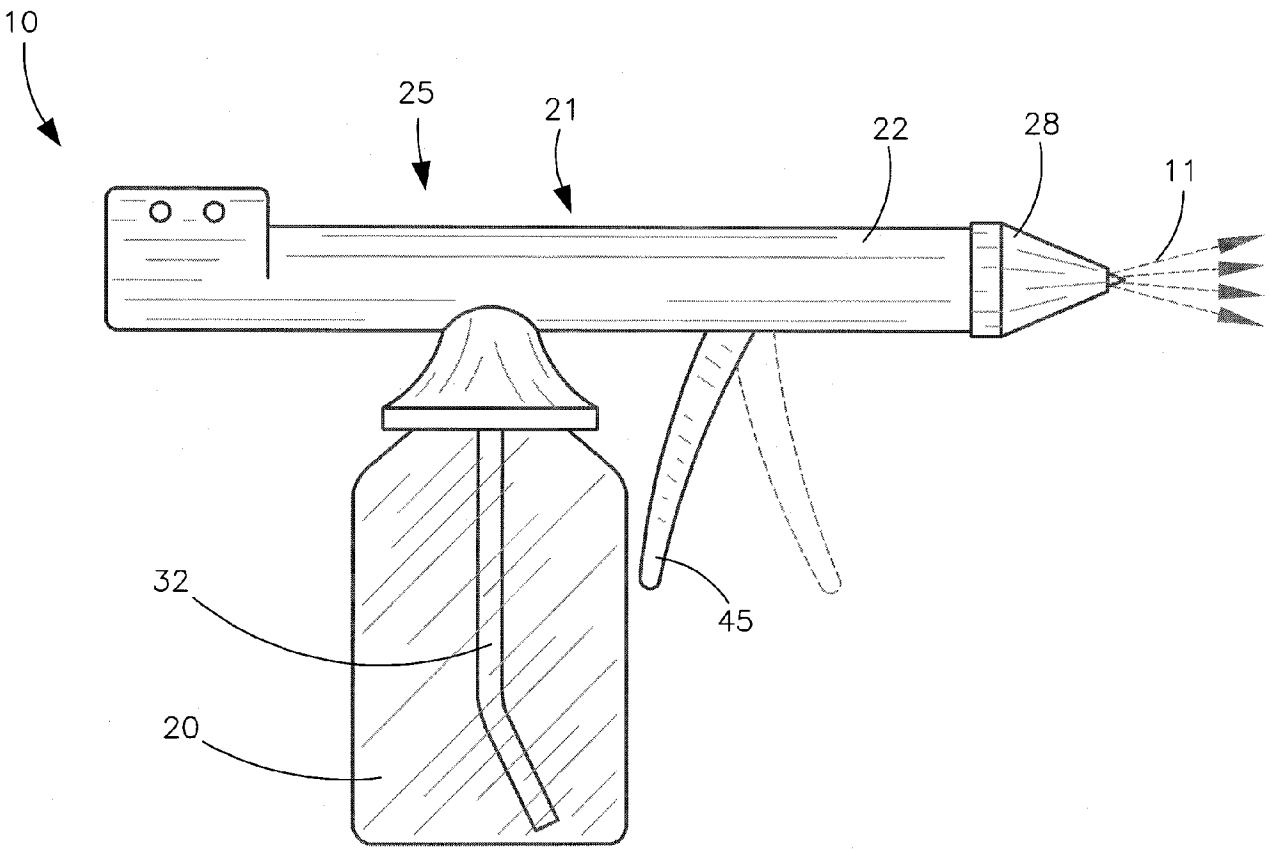
FIG. 1A is a side elevational view showing the trigger of the present invention articulated between tensioned and released positions.
Figure 2:
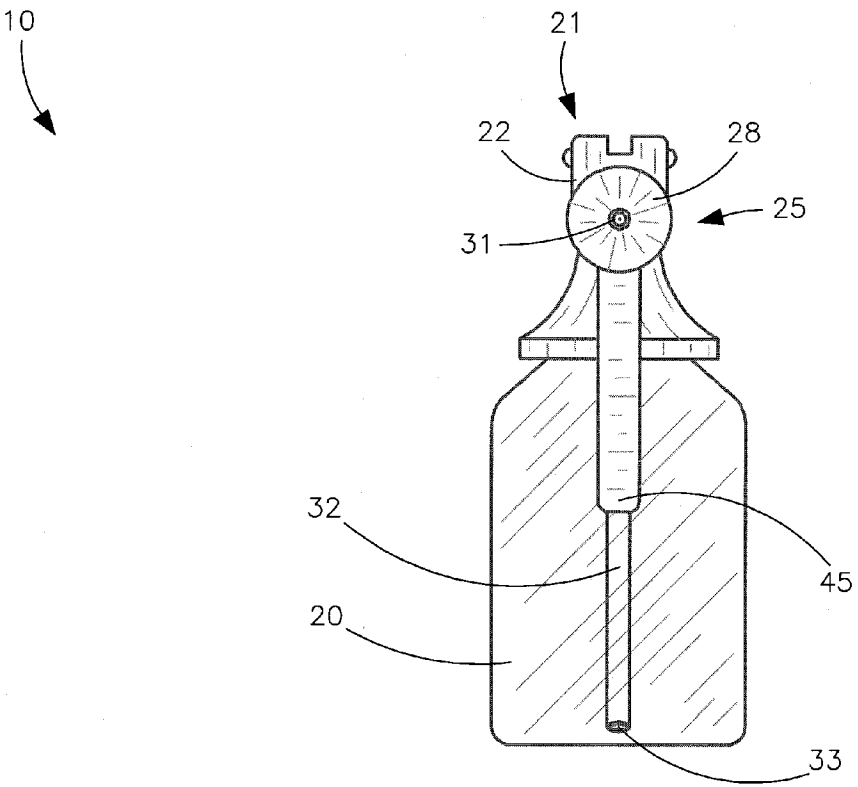
FIG. 2 is a front elevational view of the present invention.
Figure 3:
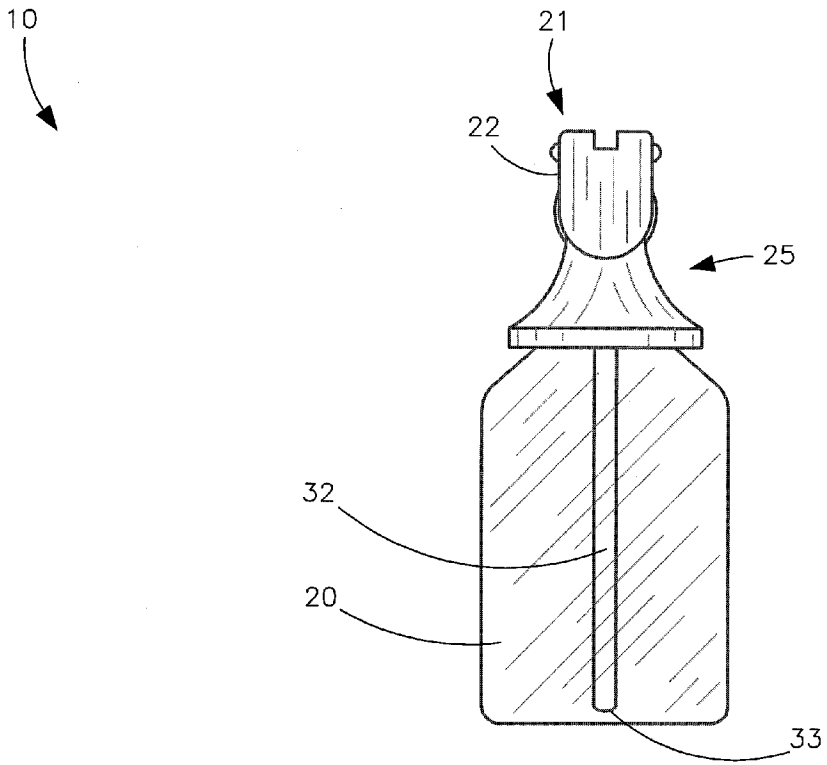
FIG. 3 is a rear elevational view of the present invention.
Figure 4:
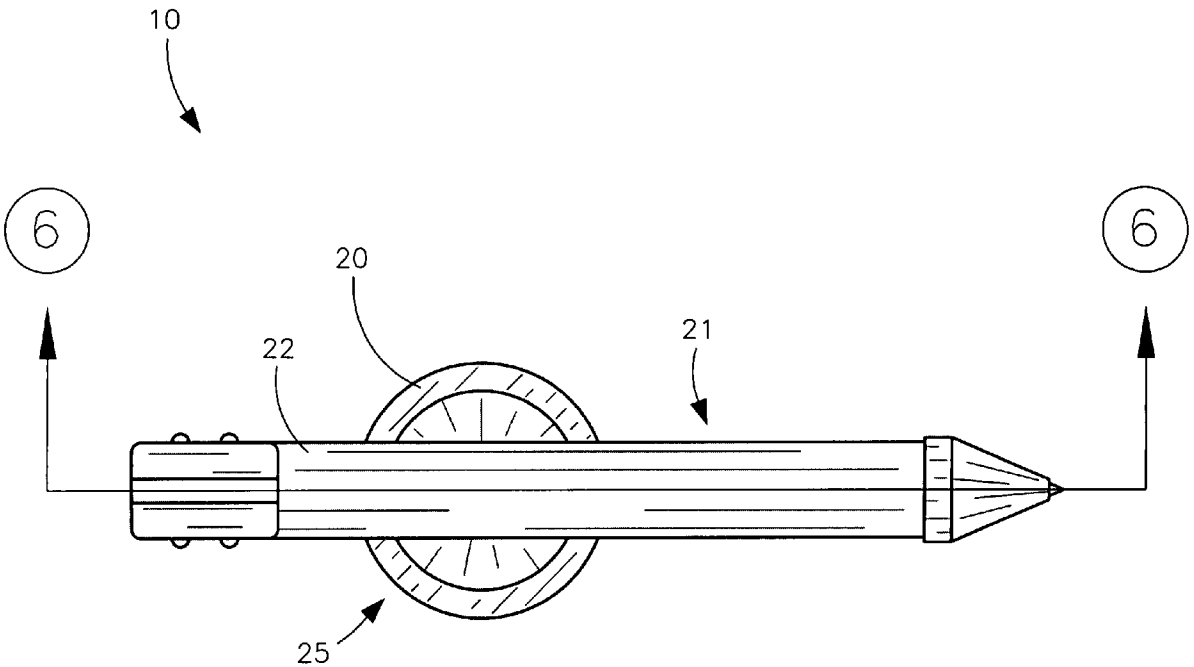
FIG. 4 is a top plan view of the present invention.
Figure 5:
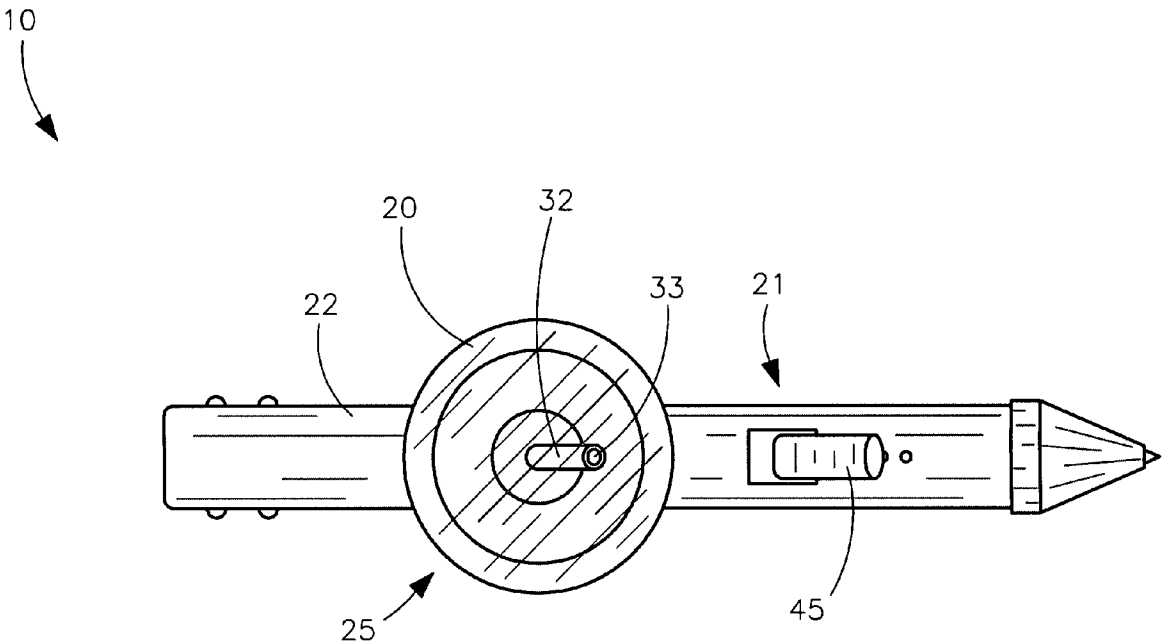
FIG. 5 is a bottom plan view of the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-6B by the reference numeral 10 and is intended to provide a manual air-actuated spray paint apparatus. It should be understood that the apparatus 10 may be used to provide the user with a means for evenly disbursing many different types of paint in a controlled manner and should not be limited in use to those applications mentioned herein. The apparatus may be used to touch up freshly painted surfaces as well as surfaces that have been damaged by wear. Additionally, the apparatus may be employed by both amateurs and professionals.

Referring initially to FIGS. 1-6B, a manual air-actuated spray paint apparatus 10 preferably includes a portable reservoir 20 for holding the paint 11 and a hand-actuated paint applicator 21. Such a hand-actuated paint applicator 21 may be removably coupled to the reservoir 20 and in fluid communication therewith. This keeps the paint 11 conveniently locked inside the apparatus 10 to prevent spills related to using a paint brush or roller. The hand-actuated paint applicator 21 may further include a housing 22 provided with first 23 and second 24 rectilinear passageways formed therein to separate the air and paint 11 until ready to be disbursed.

The hand-actuated paint applicator 21 may also include a mechanism 25 for simultaneously discharging a single stream of paint 11 and a volume of air along mutually exclusive first 26 and second 27 paths defined within the first 23 and second 24 passageways respectively. The light-weight and portable components of the present invention provide users with a convenient means of applying paint in a space-limited area that is not conducive to cumbersome power tools or equipment.

Figure 6A:
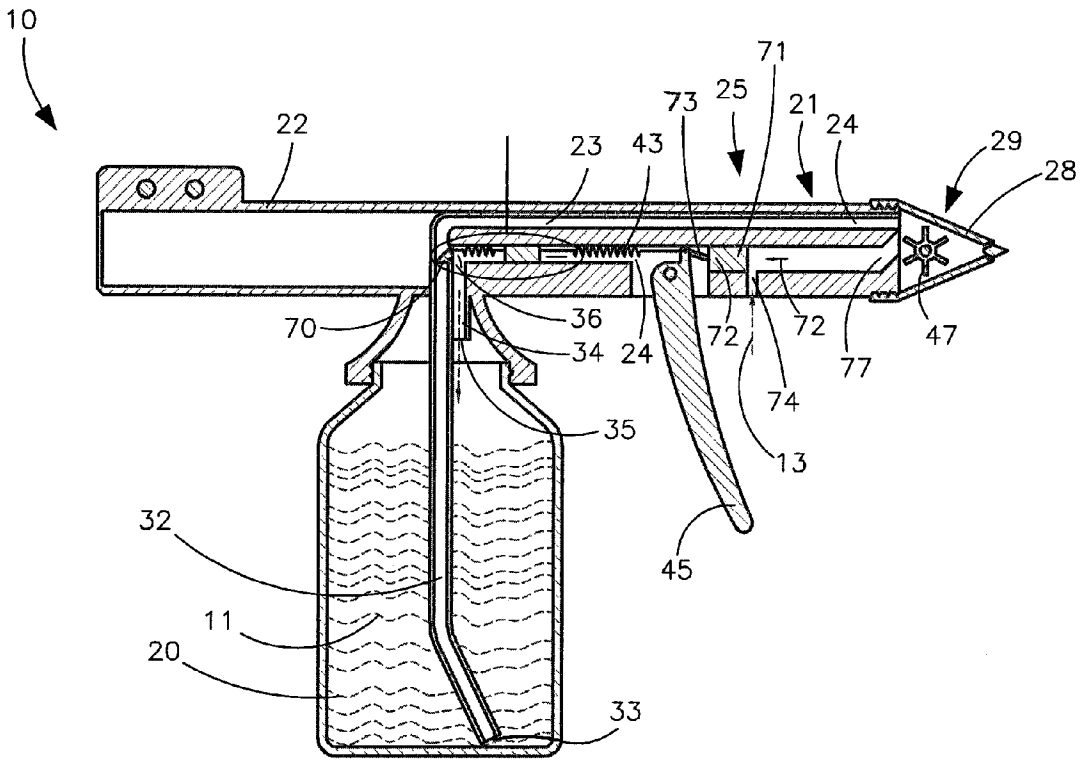
FIG. 6A is a cross sectional view of the present invention showing the trigger in the released position, taken along line 6-6, as seen in FIG. 4.
Figure 6B:
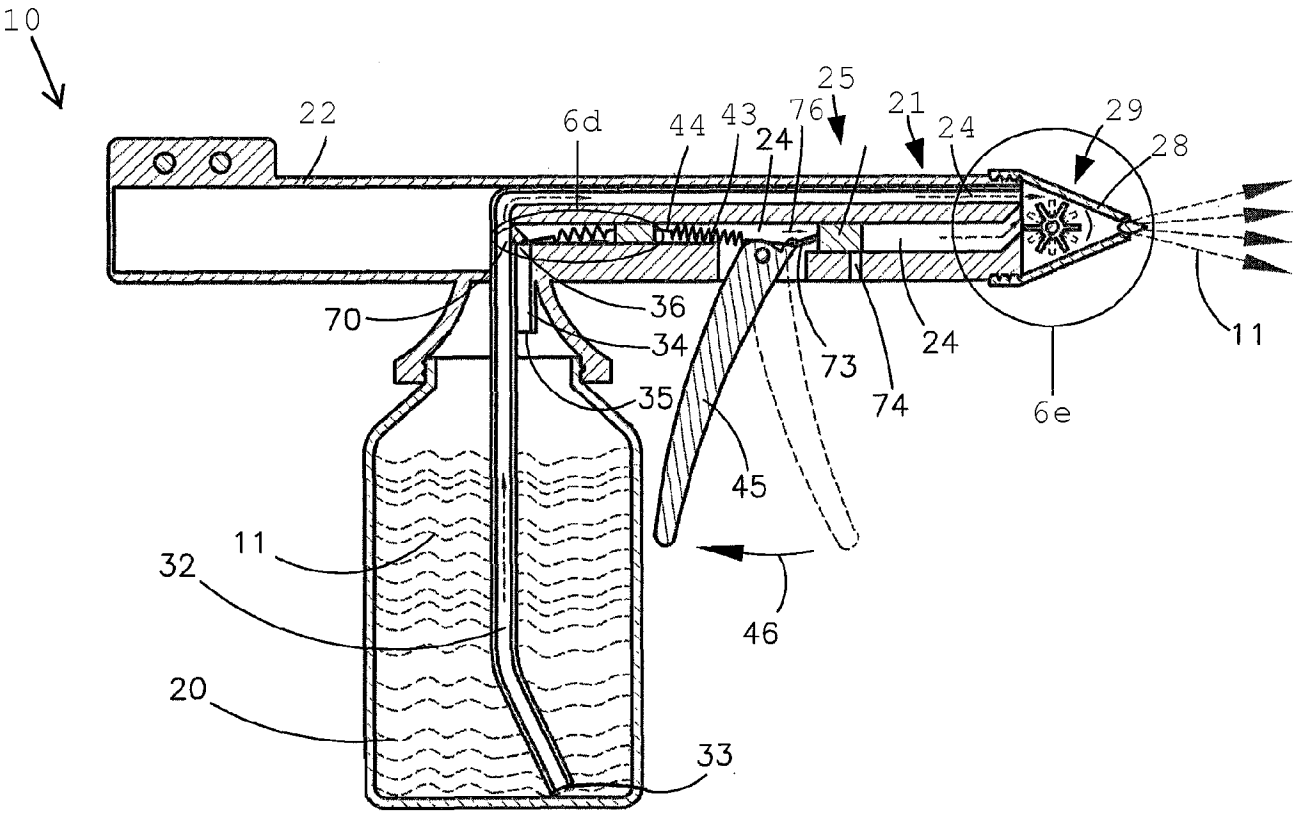
FIG. 6B is a cross sectional view of the present invention showing the trigger in the tensioned position, taken along line 6-6, as seen in FIG. 4.
Figure 6C:
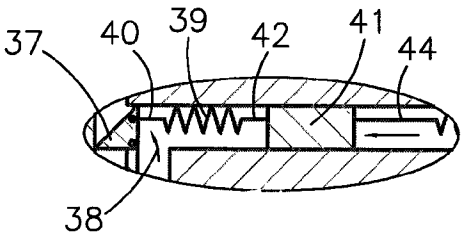
FIG. 6C is an enlarged cross-sectional view showing a rear section of the simultaneous paint and air discharging mechanism when the trigger is not squeezed.
Figure 6D:
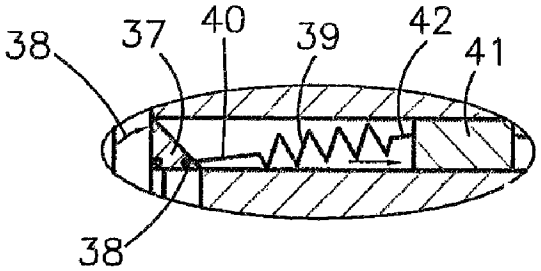
FIG. 6D is an enlarged cross-sectional view showing a rear section of the simultaneous paint and air discharging mechanism when the trigger is squeezed.
Figure 6E:
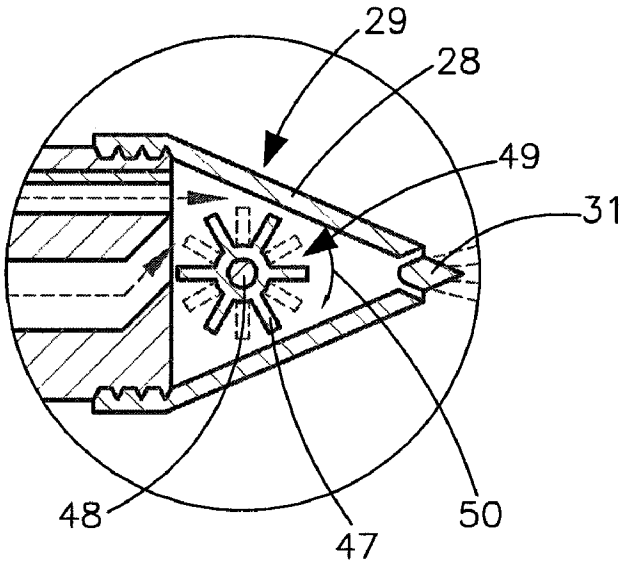
FIG. 6E is an enlarged cross-sectional view showing the paint and air mixing mechanism.

Referring to FIGS. 1, 6A, and 6B, the hand-actuated paint applicator 21 preferably includes a discharge spout 28 removably mated to the hand-actuated paint applicator 21 and in fluid communication therewith. This is vital so that the user may conveniently remove the discharge spout 28 for cleaning. Such a discharge spout 28 may include a mechanism 29 for mixing the single paint stream 11 and the volume of air after exiting the first 23 and second 24 passageways and while passing through the discharge spout 28 such that the single stream of paint 11 is scattered along a disrupted path while it is outwardly ejected from a distal end 31 of the discharge spout 28. The present invention, as claimed, provides the benefit of mixing the paint 11 at the discharge spout 28 in order to allow the air passageway to remain free of paint 11, which may dry and affect the operation of the apparatus 10.

Referring to FIGS. 1-6B, the simultaneous paint and air discharging mechanism 25 may further include a first tube 32 that has an open bottom end 33 situated within the reservoir 20 and is preferably in direct fluid communication with the paint 11 contained therein. Such a first tube 32 may further include an open top end 70 in fluid communication with the first passageway 23. The simultaneous paint and air discharging mechanism 25 may also include a second tube 34 with an open bottom end 35 situated within the reservoir 20 and elevated above the paint 11.

Such a second tube 34 may further have an open top end 36 in direct communication with the second passageway 24. Air is preferably introduced into the reservoir 20 via the second tube 34 to thereby increase air pressure within the reservoir 20 and force the paint 11 out therefrom via the first tube 32. The combined elements, as claimed, overcome the problems presented in prior art devices such as requiring connection with an external compressed air source. In overcoming such shortcoming, the present invention provides manually-actuated compressed air needed to effectively apply the paint and thus an external compressed air source is not required for operation.

Referring again to FIGS. 6A and 6B, the simultaneous paint and air discharging mechanism 25 may further include a stop valve 37 pivotally connected directly without the use of intervening elements to the first 32 and second 34 tubes respectively. Such a stop 37 valve is further preferably selectively articulated along a first curvilinear path 38 defined at the open top ends 70, 36 of the first and second passageways respectively 23, 24. Additionally, the simultaneous paint and air discharging mechanism 25 may include a first spring member 39 seated within the second passageway 24 that has a trailing end 40 coupled to the stop valve 37.

Also, the simultaneous paint and air discharging mechanism 25 may include a plunger 41 slidably interfitted within the second passageway 24. Such a plunger 41 may be coupled to a leading end 42 of the first spring member 39. Further, a second spring member 43 is preferably included that has a trailing end 44 attached to the plunger 41. Such a second spring member 43 may be situated distally away from the plunger 41.

The simultaneous paint and air discharging mechanism 25 may include a trigger 45 pivotally mated to the housing 22. Such a trigger 45 is preferably articulated between tensioned and released positions respectively allowing a user to easily activate the paint and air discharging mechanism 25 manually. The trigger may be coupled to a leading end of the second spring member 43. The combination of the stop valve 37 and the first 32 and second 34 tubes ensures that paint is directed up from the reservoir 20 and through the first 32 tube without withdrawing back into the reservoir 20 upon release of the trigger 45. This provides a consistent and dependable stream of paint 11 which is crucial to any user applying touch up paint to a surface.

Referring to the FIGS. 6A and 6B, the simultaneous paint and air discharging mechanism 25 may also include the first and second spring members 39, 43 extending and compressing linearly along the second passageway 24 when the trigger 45 is articulated along a second curvilinear path 46. The plunger 41, which may be distally displaced along the second passageway 24 to prevent interaction with the paint 11, thereby ejects the volume of air from the second passageway 24 when the trigger 45 is tensioned.

Thereafter, the plunger 41 is preferably retracted along the second passageway 24, thereby drawing in a new volume of air through the second passageway 24. The first 39 and second 43 spring members are then preferably caused to return to respective equilibrium positions when the trigger 45 is adapted to the released position. Further, the stop valve 37 may be pivoted away from the open top end 36 of the second tube 34 when the first spring member 39 is returned to equilibrium and may thereby permits the new volume of air to enter the reservoir 20 via the second tube 34 respectively.

Referring to FIGS. 6A and 6B, the manual air-actuated spray paint apparatus 10 may further include the paint 11 being directed upwardly along the first tube 32 and entering into the first passageway 23 when the trigger 45 is pivoted to the tensioned position. The stop valve 37 may be linearly displaced away from the open top end 70 of the first tube 32 thereby blocking the open top end 36 of the second tube 34 when the first spring member 39 is biased to the extended position.

Additionally, the first passageway 23 may have a diameter that is smaller than a diameter of the second passageway 24 which is vital to create pressure in the reservoir 20 so that the single stream of paint 11 exits the reservoir 20 at a faster rate than a rate that the new volume of air enters the reservoir 20. In this manner, a user may begin applying paint with the first actuation of the trigger 45 instead of having to repeatedly depress the trigger 45 in order to prime the apparatus 10 and build a sufficient air pressure within the reservoir 20.

Referring to the FIGS. 6A and 6B, the paint and air mixing mechanism 29 preferably further includes a spin wheel 47 rotatably disposed within the discharge spout 28. Such a spin wheel 47 may be located distally of the first 23 and second 24 passageways respectively. The spin wheel 47 may additionally be rotated about a fulcrum axis 48 disposed subjacent to the first passageway 23 which is advantageous such that each of the single paint 11 stream and the volume of air initially engages a top hemisphere 49 of the spin wheel 47, thereby causing the spin wheel 47 to rotate along a first arcuate path 50. This is beneficial because the apparatus 10 may be fully activated by the user's own action and thus does not require an external power source, thereby improving control during operations.

The rotation of the spin wheel 47 preferably causes the single paint 11 stream and the volume of air to become interspersed such that the single paint 11 stream is disrupted into a plurality of paint 11 droplets when exiting the discharge spout 28. The elements, as claimed, provide a benefit of allowing a wide disbursement of paint droplets so as to cover a larger area with each action and create a smoother application of the paint to the intended surface. In applying paint to a surface that has been damaged or a surface that was incompletely painted, the smooth application of the disbursed paint droplets will blend the fresh paint with the existing painted surface.

Referring again to FIGS. 6A and 6B, the simultaneous paint and air discharging mechanism 25 may further include a second plunger 71 slidably interfitted within the second passageway 24 and positioned distal to the trigger 45. A proximal end 72 of the second plunger 71 may be coupled to shaft 73. Such a shaft 73 is preferably pivotally mated with the trigger 45 which is crucial so that second plunger travels away from the trigger 45 on a third exclusive path 76 within the second passageway 24 when the trigger 45 is engaged in a tensioned position.

The simultaneous paint and air discharging mechanism 25 may also include an orifice 74 extending upwardly from the exterior of the housing 22. Such an orifice 74 may also be in fluid communication with the second passageway 24 to permit air 13 to move into the second passageway 24 when the trigger 45 is not engaged. The orifice 74 is preferably located downstream of the trigger 45 such that it is covered by the second plunger 71 when the trigger 45 is in a tensioned position.

In this manner, air that is pulled into the second passageway 24 is prevented from exiting through the orifice 74 but is instead forced out of the second passageway 24 through the distal end 77 of the second passageway 24. The combination of the first plunger 41 and the second plunger 71 provides a duel benefit. Each time the trigger 45 is engaged, the first plunger 45 forces air into the reservoir 20 along the second path 24 thereby pushing paint into the first passageway 23. While this process is occurring, the second plunger 71 simultaneously forces air out of the distal end 77 of the second passageway 24.

Thus, two independent streams of air travel in axially opposed directions within the second passageway 72 and cause the spin wheel 47 to rotate faster which results in a more effective dispersal of paint droplets. These elements overcome problems associated with other spray paint inventions which merely combine air with a stream of paint. Such other invention may disperse paint droplets in an inconsistent manner and produce undesirable results for the user.

Referring back to FIG. 1, the discharge spout 28 may further include a plurality of auxiliary nozzles, not shown but understood by one ordinarily skilled in the art, removably attached thereto for adjusting a flow rate of the paint droplets when exiting the discharge spout 28. A user can therefore adapt the apparatus to successfully apply paint in different applications, whether a wide spray is needed to cover a larger area or a more narrow spray is needed to touch up corners and grooves.

The present invention, as claimed, provides the unexpected and unpredictable benefit of a simple and convenient means of applying paint for touch ups and small painting tasks. The manual air-actuated spray paint apparatus 10 allows users to quickly apply an even coat of paint over a variety of surfaces with ease. Well suited for use with virtually any type of paint, whether latex, enamel, flat or gloss, the manual air-actuated spray paint apparatus may be utilized to neatly and evenly apply varnishes and stains. The present invention is well suited for both indoor and outdoor painting and touch up tasks and ideal for use by painters, contractors and similar professionals.

In use, a method for manually and evenly disbursing paint 11 in a controlled manner may include the first step of providing a portable reservoir 20 for holding the paint 11 therein. A second step of the method may include providing and removably coupling a hand-actuated paint applicator 21 to the reservoir 20 such that the hand-actuated paint applicator 21 is in fluid communication with the reservoir 21. The hand-actuated paint applicator 21 may preferably include a housing 22 provided with first 23 and second 24 rectilinear passageways formed therein.

In use, the method may include a third step of providing and removably mating a discharge spout 28 to the hand-actuated paint applicator 21 such that the hand-actuated paint applicator is in fluid communication with the discharge spout 28. Fourthly, the method may also include simultaneously discharging a single stream of the paint and a volume of air along mutually exclusive first 26 and second 27 paths defined within the first 23 and second 24 passageways respectively. The method may include a final step mixing the single paint 11 stream and the volume of air after exiting the first 23 and second 24 passageways and while passing through the discharge spout 28 such that the single stream of paint 11 is scattered along a disrupted path while it is outwardly ejected from a distal end 31 of the discharge spout 28.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A manual air-actuated spray paint apparatus for evenly disbursing paint in a controlled manner, said manual air-actuated spray paint apparatus comprising:

a reservoir for holding the paint therein;

a hand-actuated paint applicator coupled to said reservoir and being in fluid communication therewith, said hand-actuated paint applicator including a housing provided with first and second passageways formed therein, said hand-actuated paint applicator further including means for simultaneously discharging a single stream of the paint and a volume of air along mutually exclusive first and second paths defined within said first and second passageways respectively;

a discharge spout mated to said hand-actuated paint applicator and being in communication therewith, said discharge spout comprising means for mixing said single paint stream and the volume of air after exiting said first and second passageways and while passing through said discharge spout such that said single stream of paint is scattered along a disrupted path while being outwardly ejected from a distal end of said discharge spout;

wherein said simultaneously paint and air discharging means comprises:

a first tube having an open bottom end situated within said reservoir and in directly fluid communication with the paint contained therein, said first tube further having an open top end in fluid communication with said first passageway;

a second tube having an open bottom end situated within said reservoir and elevated above the paint, said second tube further having an open top end in direct communication with said second passageway;

wherein air is introduced into said reservoir via said second tube to thereby increase air pressure within said reservoir and force the paint out therefrom via said first tube;

wherein said simultaneously paint and air discharging means comprises:

a stop valve pivotally connected directly to said first and second tubes respectively and being selectively articulated along a first curvilinear path defined at said open top ends of said first and second passageways respectively;

a first spring member seated within said second passageway and having a trailing end coupled to said stop valve;

a plunger slidably interfitted within said second passageway and being coupled to a leading end of said first spring member;

a second spring member having a trailing end attached to said plunger and being situated distally from said plunger; and a trigger pivotally mated to said housing and being articulated between tensioned and released positions respectively, said trigger being coupled to a leading end of said second spring member.

2. The manual air-actuated spray paint apparatus of claim 1, wherein said first and second spring members are linearly extended and compressed along said second passageway when said trigger is articulated along a second curvilinear path, wherein said plunger is distally displaced along said second passageway and thereby ejects the volume of air from said second passageway when said trigger is tensioned, wherein said plunger is retracted along said second passageway and thereby draws in a new volume of air through said second passageway, wherein said first and second spring members are caused to return to respective equilibrium positions when said trigger is adapted to said released position, wherein said stop valve is pivoted away from said open top end of said second tube when said first spring member is returned to equilibrium and thereby permits the new volume of air to enter said reservoir via said second tube respectively.

3. The manual air-actuated spray paint apparatus of claim 2, wherein the paint is directed upwardly along said first tube and enters into said first passageway when said trigger is pivoted to said tensioned position, wherein said stop valve is linearly displaced away from said open top end of said first tube and blocks said open top end of said second tube when said first spring member is biased to the extended position.

4. The manual air-actuated spray paint apparatus of claim 3, wherein said first passageway has a diameter that is smaller than a diameter of said second passageway such that said single stream of paint exits said reservoir at a faster rate than a rate that the new volume of air enters said reservoir.

5. The manual air-actuated spray paint apparatus of claim 4, wherein said paint and air mixing means comprises:

a spin wheel rotatably disposed within said discharge spout and being located distally of said first and second passageways respectively, said spin wheel being rotated about a fulcrum axis disposed subjacent to said first passageway such that each of said single paint stream and the volume of air initially engages a top hemisphere of said spin wheel and thereby causes said spin wheel to rotate along a first arcuate path, wherein said spin wheel rotation causes said single paint stream and the volume of air to become interspersed such that said single paint stream is disrupted into a plurality of paint droplets when exiting said discharge spout.

6. The manual air-actuated spray paint apparatus of claim 5, wherein said discharge spout comprises: a plurality of auxiliary nozzles removably attached thereto for adjusting a flow rate of said paint droplets when exiting said discharge spout.

7. A manual air-actuated spray paint apparatus for evenly disbursing paint in a controlled manner, said manual air-actuated spray paint apparatus comprising:

a portable reservoir for holding the paint therein;

a hand-actuated paint applicator removably coupled to said reservoir and being in fluid communication therewith, said hand-actuated paint applicator including a housing provided with first and second rectilinear passageways formed therein, said hand-actuated paint applicator further including means for simultaneously discharging a single stream of the paint and a volume of air along mutually exclusive first and second paths defined within said first and second passageways respectively;

a discharge spout removably mated to said hand-actuated paint applicator and being in fluid communication therewith, said discharge spout comprising means for mixing said single paint stream and the volume of air after exiting said first and second passageways and while passing through said discharge spout such that said single stream of paint is scattered along a disrupted path while being outwardly ejected from a distal end of said discharge spout;

wherein said simultaneously paint and air discharging means comprises:

a first tube having an open bottom end situated within said reservoir and in directly fluid communication with the paint contained therein, said first tube further having an open top end in fluid communication with said first passageway;

a second tube having an open bottom end situated within said reservoir and elevated above the paint, said second tube further having an open top end in direct communication with said second passageway;

wherein air is introduced into said reservoir via said second tube to thereby increase air pressure within said reservoir and force the paint out therefrom via said first tube;

wherein said simultaneously paint and air discharging means comprises:

a stop valve pivotally connected directly to said first and second tubes respectively and being selectively articulated along a first curvilinear path defined at said open top ends of said first and second passageways respectively;

a first spring member seated within said second passageway and having a trailing end coupled to said stop valve;

a plunger slidably interfitted within said second passageway and being coupled to a leading end of said first spring member;

a second spring member having a trailing end attached to said plunger and being situated distally from said plunger; and a trigger pivotally mated to said housing and being articulated between tensioned and released positions respectively, said trigger being coupled to a leading end of said second spring member.

8. The manual air-actuated spray paint apparatus of claim 7, wherein said first and second spring members are linearly extended and compressed along said second passageway when said trigger is articulated along a second curvilinear path, wherein said plunger is distally displaced along said second passageway and thereby ejects the volume of air from said second passageway when said trigger is tensioned, wherein said plunger is retracted along said second passageway and thereby draws in a new volume of air through said second passageway, wherein said first and second spring members are caused to return to respective equilibrium positions when said trigger is adapted to said released position, wherein said stop valve is pivoted away from said open top end of said second tube when said first spring member is returned to equilibrium and thereby permits the new volume of air to enter said reservoir via said second tube respectively.

9. The manual air-actuated spray paint apparatus of claim 8, wherein the paint is directed upwardly along said first tube and enters into said first passageway when said trigger is pivoted to said tensioned position, wherein said stop valve is linearly displaced away from said open top end of said first tube and blocks said open top end of said second tube when said first spring member is biased to the extended position.

10. The manual air-actuated spray paint apparatus of claim 9, wherein said first passageway has a diameter that is smaller than a diameter of said second passageway such that said single stream of paint exits said reservoir at a faster rate than a rate that the new volume of air enters said reservoir.

11. The manual air-actuated spray paint apparatus of claim 10, wherein said paint and air mixing means comprises:

a spin wheel rotatably disposed within said discharge spout and being located distally of said first and second passageways respectively, said spin wheel being rotated about a fulcrum axis disposed subjacent to said first passageway such that each of said single paint stream and the volume of air initially engages a top hemisphere of said spin wheel and thereby causes said spin wheel to rotate along a first arcuate path, wherein said spin wheel rotation causes said single paint stream and the volume of air to become interspersed such that said single paint stream is disrupted into a plurality of paint droplets when exiting said discharge spout.

12. The manual air-actuated spray paint apparatus of claim 11, wherein said discharge spout comprises: a plurality of auxiliary nozzles removably attached thereto for adjusting a flow rate of said paint droplets when exiting said discharge spout.

13. The manual air-actuated spray paint apparatus of claim 9, wherein said simultaneously paint and air discharging means further comprises:

a second plunger slidably interfitted within said second passageway and positioned distal to said trigger;

a shaft directly coupled to a proximal end of said second plunger, said shaft being pivotally mated with said trigger such that said second plunger travels away from said trigger on a third exclusive path within said second passageway when said trigger is engaged to the tensioned position;

an orifice extending upwardly from said exterior of said housing and being in fluid communication with said second passageway to permit air to move into said second passageway when said trigger is not engaged, said orifice being located downstream of said trigger and thereby being covered by said second plunger when said trigger is biased to the tensioned position;

wherein air is pulled into said second passageway and prevented from exiting through said orifice while being forced out of said distal end of said second passageway;

wherein said first plunger forces air into said reservoir along said second path, which in turn pushes paint into said first passageway while said second plunger simultaneously forces air out of said distal end of said second passageway such that two independent streams of air travel in axially opposed directions within said second passageway.

* * * * *